US006752333B2

(12) United States Patent
Hohl

(10) Patent No.: US 6,752,333 B2
(45) Date of Patent: Jun. 22, 2004

(54) FUEL INJECTION VALVE

(75) Inventor: Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 42 days.

(21) Appl. No.: 10/169,245

(22) PCT Filed: Dec. 22, 2000

(86) PCT No.: PCT/DE00/04619

§ 371 (c)(1),
(2), (4) Date: Oct. 30, 2002

(87) PCT Pub. No.: WO01/50009

PCT Pub. Date: Jul. 12, 2001

(65) Prior Publication Data

US 2003/0116656 A1 Jun. 26, 2003

(30) Foreign Application Priority Data

Dec. 22, 1999 (DE) ..... 199 63 568

(51) Int. Cl.[7] ..... F02M 51/00

(52) U.S. Cl. ..... 239/585.1; 239/583; 239/584; 239/585.2; 239/585.3; 239/585.4; 239/585.5; 239/533.7

(58) Field of Search ..... 239/533.7, 583, 239/584, 585.1, 585.2, 585.3, 585.4, 585.5, 533.2

(56) References Cited

U.S. PATENT DOCUMENTS

| | | | | |
|---|---|---|---|---|
| 4,153,200 A | | 5/1979 | Fenne | |
| 5,423,482 A | * | 6/1995 | Mueller et al. | 239/1 |
| 5,709,195 A | | 1/1998 | Drummer et al. | |
| 6,213,414 B1 | * | 4/2001 | Stier et al. | 239/584 |
| 6,543,702 B1 | * | 4/2003 | Stier | 239/102.2 |
| 6,685,105 B1 | * | 2/2004 | Ruehle et al. | 239/102.1 |

FOREIGN PATENT DOCUMENTS

| | | | | |
|---|---|---|---|---|
| DE | 196 46 847 | | 6/1997 | |
| DE | 197 03 836 | | 8/1998 | |
| DE | 197 12 591 | | 10/1998 | |
| JP | 58110856 A | * | 7/1983 | F02M/51/08 |

* cited by examiner

*Primary Examiner*—Robin O. Evans
(74) *Attorney, Agent, or Firm*—Kenyon & Kenyon

(57) ABSTRACT

A fuel injector, especially a fuel injector for injection systems of internal combustion engines, includes a solenoid which works together with an armature and a valve needle to actuate a valve-closure member, which together with a valve-seat surface forms a sealing seat. A longitudinal axis of the valve needle is inclined by a prescribed angle with respect to a longitudinal axis of a valve housing. The armature is linked with an actuating body whose longitudinal axis is inclined with respect to the longitudinal axis of the valve needle and which acts on the valve needle through a hydraulic device.

11 Claims, 1 Drawing Sheet

FUEL INJECTION VALVE

FIELD OF THE INVENTION

The present invention relates to a fuel injector.

BACKGROUND INFORMATION

A fuel injector is referred to in German Published Patent Application No. 197 12 591. The fuel injector discussed in that publication includes a valve-closure member actuatable by an actuator using a valve needle, which valve-closure member cooperates with a valve-seat surface to form a sealing seat. The fuel injector includes a connecting part and a functional part. An electrical connection and a fuel connection are provided on the connecting part. The functional part includes the actuator, a compression spring and a valve-seat member on which the valve-seat surface is formed. The entire actuating device necessary for actuating the fuel injector is thus accommodated in the functional part. When the functional part is joined to the connecting part, an electrical contact pin of the functional part is inserted into a socket of the connecting part, whereby the actuator is joined with the electrical connector of the connecting part. In addition, a fuel channel in the functional part is joined with a fuel channel in the connecting part by a leakproof connection. Because the connecting part is chamfered on a connecting side, on which it is joined with the functional part, the functional part may be joined with the connecting part at a fixed pivoting angle.

A disadvantage of the fuel injector referred to in German Published Patent Application No. 197 12 591 is in particular the bend in the valve housing. It makes insertion of the fuel injector into an insertion bore of an internal combustion engine difficult, since the fuel injector may not be screwed for example into a cylindrical connection piece. In particular, this fuel injector may not be inserted into a cylindrical insertion bore of a cylinder head, as is necessary for fuel injectors which inject directly into the combustion chamber of the internal combustion engine. Since the fuel injector is subdivided into a connecting part and a functional part, with the entire actuating device accommodated in the functional part, fabrication is very complex.

SUMMARY OF THE INVENTION

The exemplary fuel injector according to the present invention may provide that the angle of inclination may be modified independent of the external shape of the valve housing, so that the fuel injector may be utilized flexibly. In addition, the actuating device may be positioned in the fuel injector independently of the angular position of the valve needle, so that the present invention is suitable for any desired fuel injectors with any desired actuators. The housing of the fuel injector includes no bend, so that it may be inserted for example into a cylindrical insertion bore of a cylinder head of an internal combustion engine.

Changes to the angle of inclination are possible through slight changes when manufacturing individual components of the fuel injector, without needing to adapt the entire production process.

The hydraulic device through which the fuel injector is actuated may be used not only for angle conversion, but also to transmit the lift of the actuating body. This allows for greater lift of the actuating body.

The hydraulic device may be made by production techniques as an insertable component and may be inserted into the injector valve as a complete component. The hydraulic device is therefore not subject to any great risk of damage during installation.

One exemplary embodiment of the present invention is illustrated in simplified form in the drawings and explained in greater detail in the following description.

DETAILED DESCRIPTION

Figure 1:
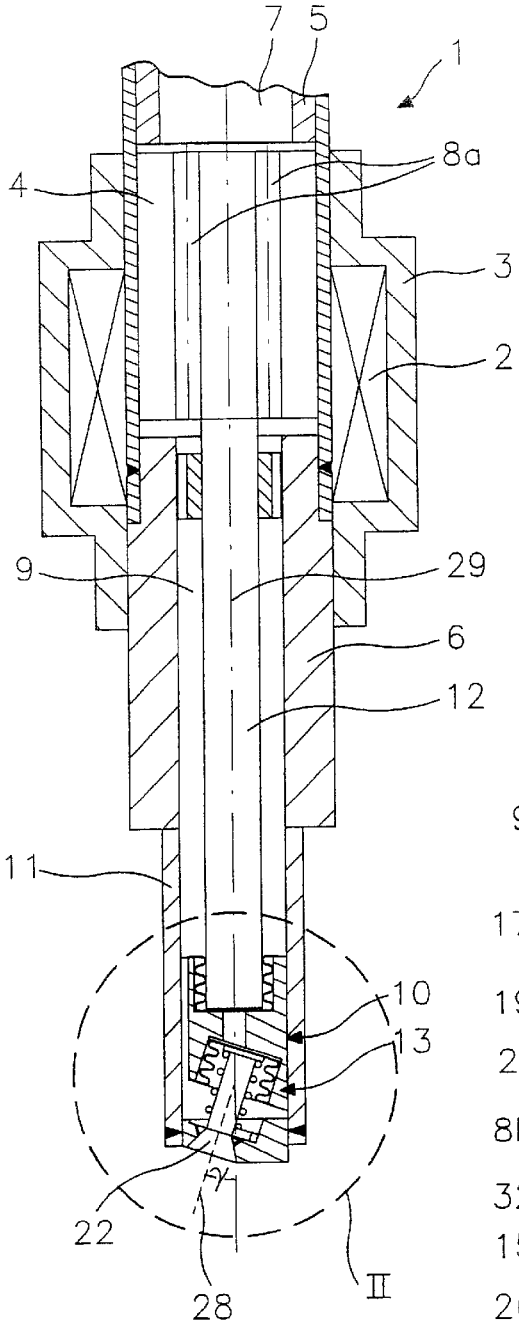
FIG. 1 shows an axial section through an exemplary embodiment of a fuel injector configured according to the present invention.

FIG. 1 shows a partial axial sectional depiction of an exemplary embodiment of fuel injector 1 according to the present invention, which is configured as an outward opening fuel injector 1 and is suitable in particular for direct injection of fuel into a combustion chamber (not shown) of an internal combustion engine having spark ignition and fuel mixture compression.

Fuel injector 1 includes a solenoid 2 which is surrounded by a magnetic reflux body 3, as well as an armature 4 which is positioned between a core 5 and a connecting part 6 and works together with solenoid 2. The fuel is fed in centrally through a fuel supply system 7 and conveyed through fuel channels 8*a* in armature 4, a central recess 9 in fuel injector 1 and an insertable component 10 on the injection-side end, to the sealing seat. Fuel injector 1 is surrounded on its injection side by a valve housing section 11, into which insertable component 10 may be inserted. Armature 4 is frictionally linked with a plunger-like or valve-needle-like actuating body 12, whose injection-side end acts on insertable component 10. Insertable component 10 is fastened in the correct position to a valve-seat member 23 in valve housing section 11.

Insertable component 10 includes a hydraulic device 13, a body 14 which surrounds the hydraulic device 13, a valve needle 15 and a sealing seat 22, 24. The individual components are explained in greater detail in the description of FIG. 2.

Figure 2:
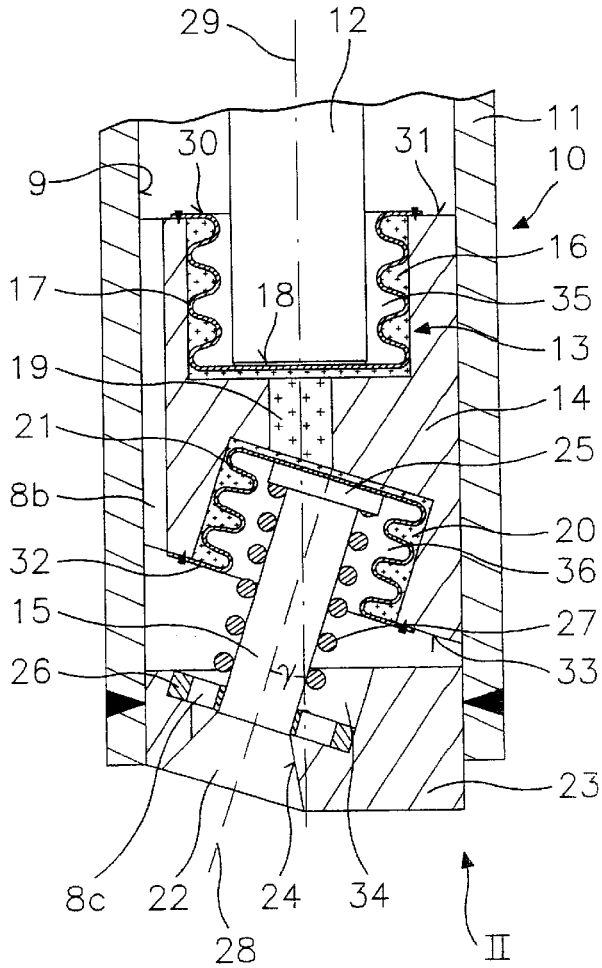
FIG. 2 shows the detail designated in FIG. 1 with II, of the area on the injection side of the exemplary fuel injector configured according to the present invention shown in FIG. 1.

FIG. 2 shows an enlarged sectional view of the detail of the injection-side end of an exemplary fuel injector 1 according to the present invention, identified in FIG. 1 with II.

Hydraulic device 13 is constructed as follows: Actuation body 12 projects into a first recess 35 formed at the infeed-side end of insertable component 10, which recess 35 includes a cylindrical cross section in the present exemplary embodiment and in which there is a first corrugated tube 17. First corrugated tube 17 is of pot-shaped configuration and lies with its rim 30 against infeed-side face 31 of insertable component 10. Rim 30 of first corrugated tube 17 may be in particular welded to face 31 of insertable component 10. It seals a first chamber 16 between corrugated tube 17 and the wall of recess 35 against the fuel which is conveyed through a fuel channel 8*b* between valve housing section 11 and insertable component 10 to sealing seat 22, 24. Actuating body 12 is braced by a lower face 18 against the bottom of first corrugated tube 17. The space between the wall of first recess 35 and first corrugated tube 17 forms first chamber 16, and is filled with a hydraulic medium.

First chamber 16 is connected with a second chamber 20 through a connecting channel 19, which may be cylindrical in shape and is filled with hydraulic medium. Second chamber 20 is formed on the injection-side end of insertable component 10. In a second recess 36, which is in particular cylindrically shaped, a second corrugated tube 21 which is pot-shaped is arranged in the same manner as first corrugated tube 17 in first chamber 16. Second corrugated tube 21 lies with a rim 32 against an infeed-side face 33 of insertable component 10 and may be in particular welded to it to seal second chamber 20 against the fuel. Valve needle 15 projects into second chamber 20. Valve needle 15 is braced by its end with a widening 25 in second recess 36 on the bottom of second corrugated tube 21. On valve needle 15 a valve-closure member 22 is formed in the direction of injection. A valve-seat surface 24 is formed on valve-seat member 23, so that valve-closure member 22 forms the sealing seat with valve-seat surface 24. Between widening 25 and an abutment 26 through which valve needle 15 projects and which includes fuel channels 8*c*, a closing spring 27 is situated. Abutment 26 in the present exemplary embodiment is plate-shaped. Abutment 26 may also be configured as a single piece with valve-seat member 23 and be situated in a recess 34 of valve-seat member 23. Closing spring 27 holds fuel injector 1 closed when no current is flowing through solenoid 2.

A longitudinal axis 28 of valve needle 15 is inclined by an angle γ with respect to a longitudinal axis 29 of fuel injector 1 or of actuating body 12. The angle of inclination γ, and with it the injection direction of fuel injector 1, depend only on the shape of valve-seat member 23 and of body 14 which surrounds hydraulic device 13. In the exemplary embodiment depicted, infeed-side face 31 of insertable component 10 runs perpendicular to longitudinal axis 29 of actuating body 12, while injection-side face 33 of insertable component 10 has an orientation which deviates by 90°, namely by angle γ, from longitudinal axis 29. If some different angle of inclination γ is to be achieved, it is only necessary to make appropriate changes to the forenamed parts, while the outer shape of fuel injector 1 is preserved.

If an electric exciting current is supplied to solenoid 2, armature 4 is drawn into solenoid 2 in the direction of injection. That causes actuating body 12, which is mechanically linked to armature 4, to also be moved in the direction of injection. Since face 18 of actuating body 12 is in contact with first corrugated tube 17, first corrugated tube 17 is elongated in the direction of injection, and the hydraulic medium which is present between first corrugated tube 17 and the wall of first chamber 16 is thereby displaced. The lift of armature 4 is thus transmitted through actuating body 12 to hydraulic device 13.

If hydraulic medium is displaced from first chamber 16 through the action of actuating body 12, it escapes into connecting channel 19 and second chamber 20. Due to the increase in volume of the hydraulic medium in second chamber 20, second corrugated tube 21 is compressed, whereby valve needle 15, which is in contact with second corrugated tube 21 with widening 25, is moved against the force of closing spring 27 in the direction of injection. The fuel, which flows through fuel channels 8*a* and central recess 9 of fuel injector 1 in the direction of insertable component 10 and is conveyed through fuel channels 8*b* in insertable component 10 and fuel channels 8*c* in abutment 26 to the sealing seat, may be injected into an intake pipe or into a combustion chamber of the internal combustion engine when the valve is open.

If the current which excites solenoid 2 is turned off, the pressure exerted on first corrugated tube 17 by actuating body 12 decreases. As a result, the hydraulic medium may be equalized from second chamber 20 through connecting channel 19 into first chamber 16, so that the tension is removed again from second corrugated tube 21 and valve needle 15 returns to the closed position.

The round cross-sectional areas of first chamber 16 and of second chamber 20 may be chosen equal in size if only a conversion of the angle of lift of armature 4 in hydraulic device 13 is desired. However a smaller cross-sectional area for second chamber 20 than the cross-sectional area of first chamber 16 may be chosen, whereby a gearing of a small armature lift into a greater valve needle lift may be achieved.

The present invention is not confined to the exemplary embodiment described, but is also suitable in particular for any injection angles desired, as well as for an inward opening fuel injector 1.

What is claimed is:

1. A fuel injector for a fuel injection system of an internal combustion engine, comprising:

an excitable actuator;

a valve-seat surface;

a valve-closure member, wherein the valve-seat surface and the valve-closure member cooperate to form a sealing seat;

a valve needle to actuate the valve-closure member;

a valve housing;

a hydraulic device;

an actuating body to act on the valve needle through the hydraulic device; and an armature linked to the actuating body;

wherein a longitudinal axis of the valve needle is inclined at a predefined angle to a longitudinal axis of the valve housing, and a longitudinal axis of the actuating body is inclined with respect to the longitudinal axis of the valve needle.

2. The fuel injector of claim 1, wherein the hydraulic device includes a first chamber and a second chamber, a connecting channel connects the first chamber and the second chamber, and the first chamber and the second chamber is filled with a hydraulic medium.

3. The fuel injector of claim 2, wherein the first chamber, the second chamber and the connecting channel are formed in an insertable component that is insertable into a central recess of the fuel injector and securable there.

4. The fuel injector of claim 3, wherein the first chamber is formed at an infeed-side end of the insertable component.

5. The fuel injector of claim 4, wherein a face of the actuating body is in contact with a corrugated tube that terminates the first chamber on the infeed side.

6. The fuel injector of claim 5, wherein the corrugated tube is arranged so that a rim of the corrugated tube is in contact with an infeed-side face of the insertable component and seals the first chamber from a fuel.

7. The fuel injector of claim 2, wherein the second chamber is formed on an injection-side end of the insertable component.

8. The fuel injector of claim 7, wherein the valve needle is in contact with a second corrugated tube that terminates the second chamber on an injection side.

9. The fuel injector of claim 8, wherein the second corrugated tube is arranged so that a rim of the second corrugated tube contacts an injection-side face of the insertable component and seals the second chamber from the fuel.

10. The fuel injector of claim 2, wherein a cross-sectional area of the second chamber is less than a cross-sectional area of the first chamber.

11. The fuel injector of claim 6, wherein the infeed-side face of the insertable component extends perpendicularly to the longitudinal axis of the actuating body, and an injection-side face of the insertable component is oriented at an angle to the longitudinal axis of the actuating body, which deviates from 90° by a magnitude of the angle.

* * * * *